US007144319B2

(12) United States Patent
Abe et al.

(10) Patent No.: US 7,144,319 B2
(45) Date of Patent: Dec. 5, 2006

(54) ROTATING PUSHER DISK FOR A COIN DISPENSING DEVICE

(75) Inventors: Hiroshi Abe, Iwatsuki (JP); Motoharu Kurosawa, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 29 days.

(21) Appl. No.: 11/091,208

(22) Filed: Mar. 28, 2005

(65) Prior Publication Data

US 2005/0233684 A1 Oct. 20, 2005

(30) Foreign Application Priority Data

Mar. 31, 2004 (JP) ..... 2004-107051

(51) Int. Cl.
*G07D 1/00* (2006.01)

(52) U.S. Cl. ..... 453/57; 453/51; 453/53

(58) Field of Classification Search ..... 453/57, 453/18, 49, 51, 53, 54, 33, 34, 35
See application file for complete search history.

(56) References Cited

U.S. PATENT DOCUMENTS 5,282,769 A 2/1994 Suzukawa

FOREIGN PATENT DOCUMENTS

JP 5-94575 4/1993
JP 2000-306132 2/2000

*Primary Examiner*—Patrick Mackey
*Assistant Examiner*—Mark J Beauchaine

(57) ABSTRACT

A coin dispensing unit includes rotating disk assembly having a plurality of apertures therein of the size to pass coins stored in a storage bowl. A guide plate below and offset from the rotable disk provides a sliding support surface for coins. A rotable roller unit is positioned at the bottom of the rotable disk adjacent a downstream edge of the aperture for relative rotation with a respective coin sliding on the guide plate.

9 Claims, 5 Drawing Sheets

(A)

(B)

(C)

(A)

(B)

(C)

ROTATING PUSHER DISK FOR A COIN DISPENSING DEVICE

BACKGROUND OF THE INVENTION

1. Field of the Invention

The present invention represents an improvement in a coin dispensing unit capable of selectively removing coins from a storage bowl and more particularly is directed to a compact rotable disk having a plurality of apertures for passing coins to a supported guide plate with a pusher device positioned adjacent a downstream edge of each aperture for providing a durable and varying contact pushing surface for the respective coins.

2. Description of Related Art

Coin dispensing apparatus for dispensing tokens, coins and other objects of value are used in a wide variety of machines such as gambling apparatus, coin changers, ticket dispensing machines, vending machines, etc. There is a demand to provide a highly compact, efficient and relatively inexpensive coin dispensing units for incorporation into such machines. Frequently the coin hoppers or storage bowls may be mounted at a lower position in such machines to maximize the efficiency and storage capabilities of, for example, a vending machine. The coins are selectively removed from the storage bowl and introduced into an escalator frequently formed of guide plates for elevating the coins one by one to a dispensing location. Alternatively, the coin dispensing unit can release the coins for a gravity feed to a lower dispensing point to the user.

U.S. Pat. No. 5,282,769 discloses a coin sorting device for use with an escalator wherein a coin from a coin dispensing unit located within a storage bowl is contacted with a rotating scraper which delivers coins to a series of guide rollers to permit the transportation of the coins to the lower end of the coin carrier duct or escalator.

Another example of the prior art having a coin-carrying disk rotor for a hopper-type coin discharging device can be found in the Japanese Patent No. 3026806. In this structure a backward-curved blade projects on the rear side of a disk rotor body and is divided into a roof-side blade piece and a front-side blade piece, spaced from each other to provide a relief recess groove for a coin guide. Metallic reinforcing pins are brought into contact with the coin and are implanted in the respective roof-side blade piece and front-side blade piece.

When the prior art coin escalators lift the coins to an upper position, for example in a vending machine, there is frictional resistance in moving the coin from primarily a horizontal location to a vertical position for being transported up the escalator. Additionally, the coins are pushed by the subsequently released coins and therefore the weight of the coins can exert a counter-force against a rotable disk releasing the coins from the hopper.

As a result, component parts can become worn and repair can be more frequently required than desired due to the high volume of coins that can be dispensed.

Thus, the prior art is still seeking improvements in this field where literally millions of coin dispensing units are in operation and due to the high labor costs involved, more coin dispensing units may be needed in the future.

SUMMARY OF THE INVENTION

A coin dispensing unit for operatively selecting coins from a storage bowl includes a rotable disk having a plurality of apertures therein of a size to pass coins stored in the storage bowl. The rotable disk can be formed from a resin material with an internal supporting metallic frame. The apertures can be provided with a downward sloping metal perimeter for contacting and passing coins from the storage bowl.

A guide plate is stationarily positioned to slidingly support coins that have passed through the apertures and are then carried by the movement of the rotable disk to an exit or outlet position.

Rotable rollers are positioned adjacent a downstream edge of each of the rotable disk apertures and provide rotational pushing section. Each rotable roller extends toward the lower guide plate a sufficient distance to ensure a pushing rotable contact with the coin. Since the rotable roller rotates, it can provide a variable contact surface and thereby increase the service life of the rotable roller.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The term "coin" is used generically to include monetary coins, tokens, medallions or other objects that can be stored in bulk and dispensed by a rotable disk with apertures to selectively transport the objects.

Figure 1:
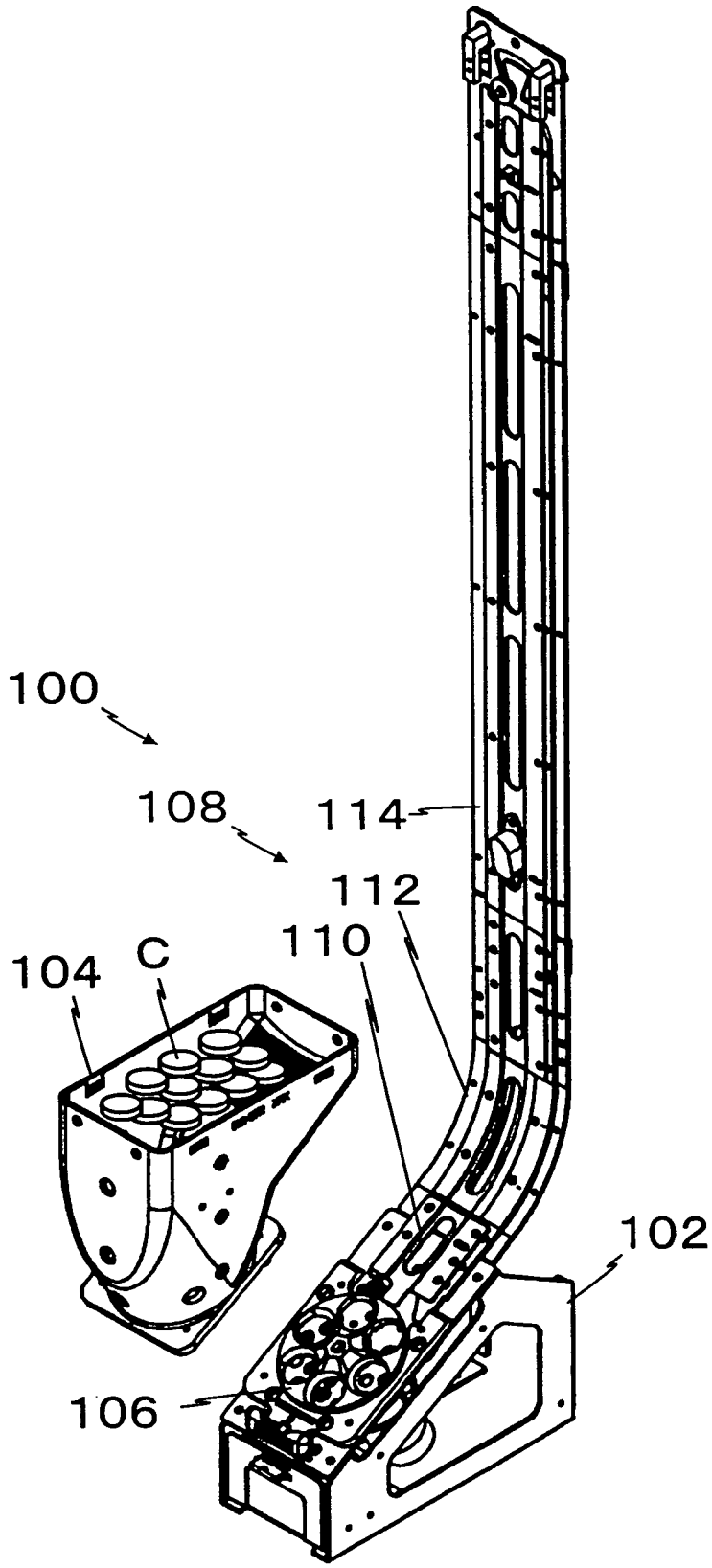
FIG. 1 is an exploded perspective view of a coin hopper with a rotating disk of a first embodiment of the present invention.

Referring to FIG. 1 the structure of a coin hopper 100 can be seen. The coin hopper 100 includes a frame 102 that can be removably mounted in, for example, a vending machine. A coin-storing bowl 104 can store bulk coins C. The coin-storing bowl 104 can be removably fixed above a coin let off or release section 106 which is operatively positioned beneath the storing bowl 104 for rotating within an aperture at the bottom of the storage bowl 104. An escalator or coin guiding unit 108 includes a guiding slanted section 110 which receives the coins from the release section 106 and a transitional curve section 112 for gradually inclining the coins so that their center will be rotated relatively traversed to a vertical plane. The curved section 112 delivers the coins to a relatively straight guiding section 114 which will extend relatively perpendicular to the support frame surface.

A released coin C from the let off or release section 106 can be pushed by subsequently released coins C which are selectively released as they drop through the apertures and are delivered to the entrance of the slanted guide section 110. Thus the coins C are eventually delivered to the straight vertical section 114 after passing through the slanted section 110 and the curved section 112. Subsequently, the coin C can be dispensed one by one from the upper end of the straight section 114.

Figure 2:
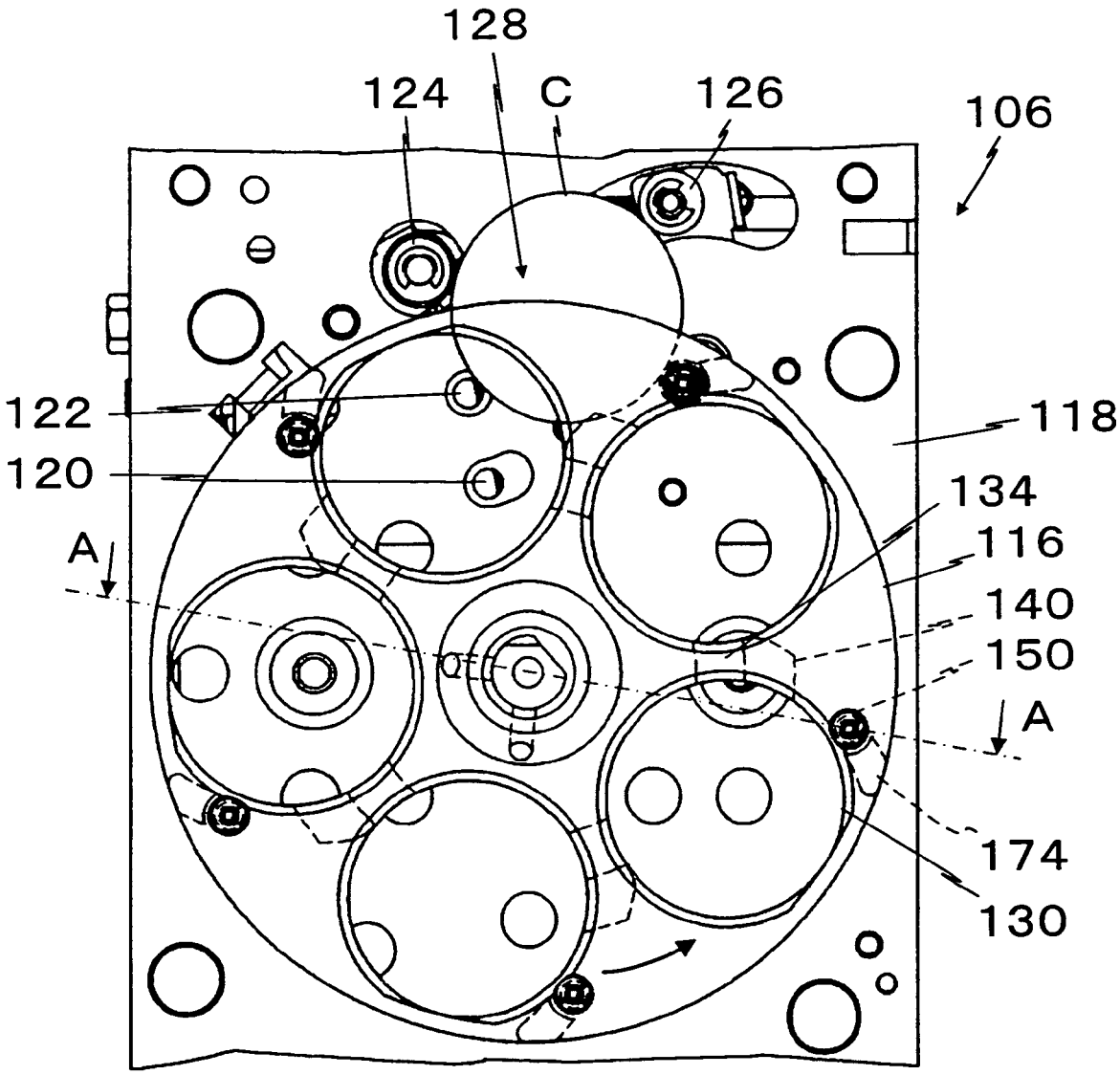
FIG. 2 is a partial plan view of a coin dispensing unit with the storage bowl removed to disclose the operative components of the rotating disk.

The details of the release or let off section 106 can be explained by referring to FIG. 2. Let off section 106 includes a rotating disk body 116 which is operatively located to align with a hole (not shown) at the bottom of the coin storing bowl 104. A flat slide supporting base 118 is offset in a parallel plane from the bottom surface of the rotating disk body 116. The offset is sufficient to permit coins to slide beneath the rotating disk body 116 after they are released through the apertures. A first exit guide pin 120 and a second exit guide pin 122 are positioned at an outlet or release position with the slide supporting base 118 positioned beneath the rotating disk body 116.

Offset from the outer edge from the rotating disk body 116 is a guiding roller 124 and a regulating roller 126.

The first guide pin 120 and the second guide pin 122 protrude upward towards a rotating disk body 116 from the slide supporting base 118 and will contact each of the respective coins C to direct them to an outlet position 128.

The guiding roller 124 includes a roller which can rotate about a supporting post that is stationarily positioned near a side of the rotating disk body 116 on the slide supporting base 118. The coin C that contacts the guiding roller 124 is also forced into contact with the regulating roller 126 which is mounted so that it can be relatively biased to move in an open and closed direction traverse to the outlet path 128. In other words, the coin regulating roller 126 is urged toward the guide roller 124 by an urging or biasing means such as a spring. Coins C that pass between the guide roller 124 and the regulating roller 126 are further guided to the coin guiding unit 108 by a conventional guide structure (not shown).

Referring to FIGS. 3A through 3C, rotating disk 116 is a circular plate having a plurality of holes, five holes 130 in this embodiment, that are located at equal intervals adjacent the edge of the rotating disk 116 so that individual coins can pass through the respective holes. Preferably the rotating disk 116 is made from a plastic resin material with a light-weight configuration and it is also possible to include an imbedded metal plate 132 which is sandwiched at the middle of the thickness of the rotating disk 116 for maintaining a desired predetermined strength.

Figure 4:
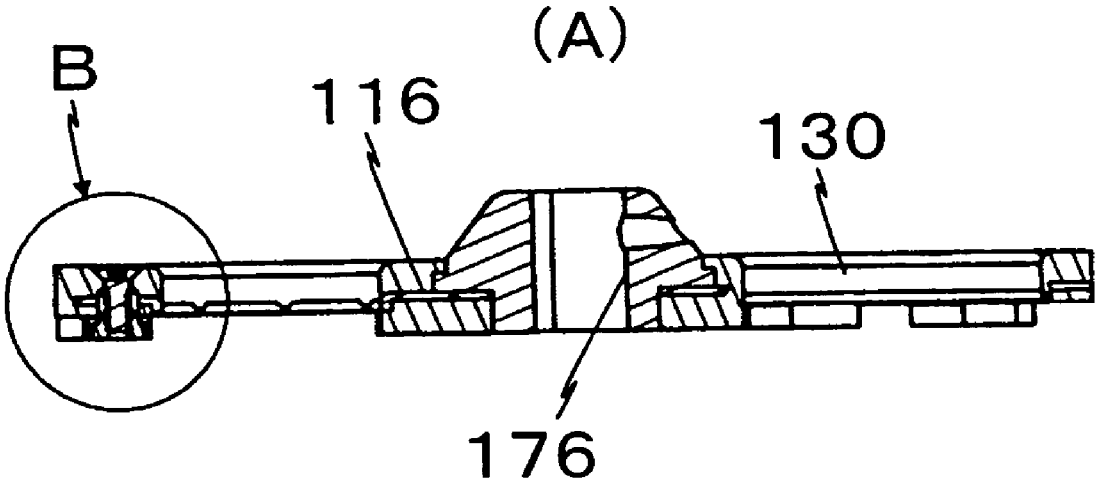
FIG. 4A is a cross-sectional view taken along the line A—A in FIG. 2.
FIG. 4B is an expanded view of rotable roller unit indicated in FIG. 4A.
Figure 4:
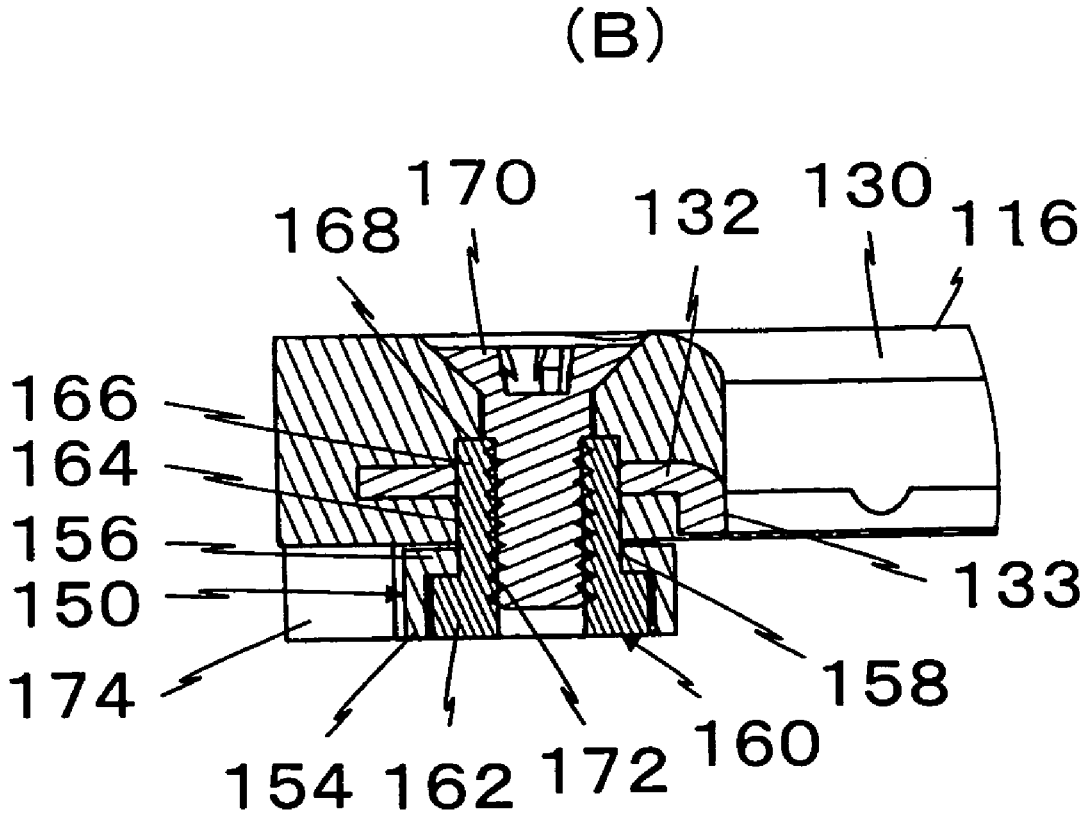

Referring to FIG. 4B, a circular edge which is part of the through holes 130 of the metal plate 132 can be bent or curved in a downward direction for providing an appropriate bearing surface as the coins C pass through the respective holes. The circular edge includes the flange 133 which has a ring-like shape. The metal plate 132 has sufficient strength and further can help prevent wearing of the through holes 130.

As shown in FIG. 2, ribs 134 can be located between respective through holes 130.

Figure 3:
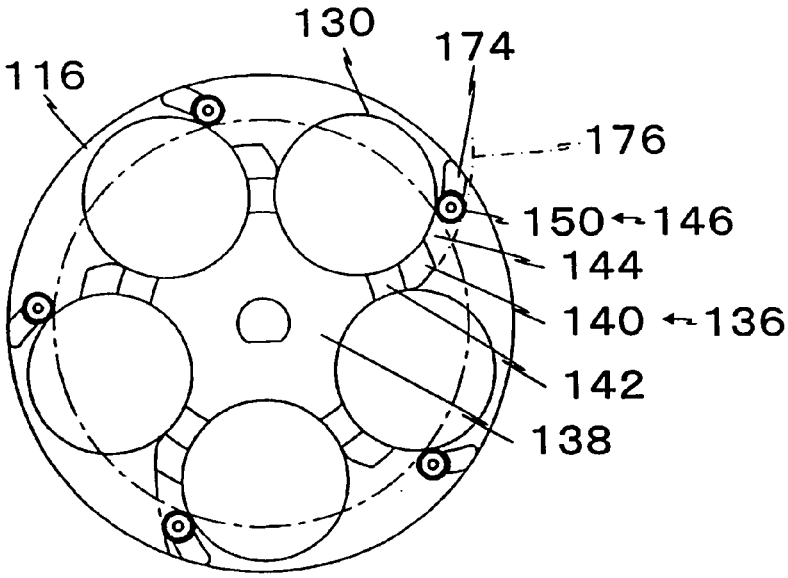
FIG. 3A is a reverse view of the rotable disk of the first embodiment.
FIG. 3B is a perspective view of the upper surface of the rotable disk.
FIG. 3C is a reverse perspective view of the rotating disk.
Figure 3:
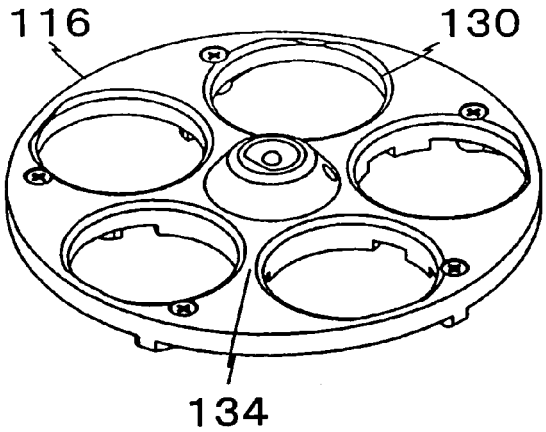
Figure 3:
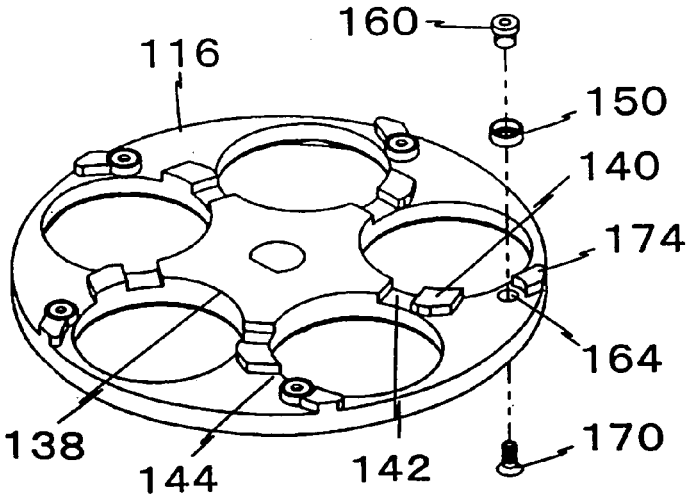

As shown in FIG. 3, pushing sections 136 of the coin C are located on the reverse side on the ribs 134 and are extended towards the peripheral direction of the rotating disk 116 so that they are inclined back towards the rotating direction of the rotating disk as an involute curve. In other words, the pushing section 136 is located face-to-face with respect to each of the through holes 130.

A middle section 138 is located at the center of the rotating disk 116 and is slightly thicker than the thickness of the coin C. A first pushing section 140 is located a predetermined distance away from the center section 138 and has a thickness of the same dimension as the center section 138 and can be of a rectangular shape as shown in FIG. 3. A first groove 142 is located between the center section 138 and the first pushing section 140. The first groove 142 has an arc shape with a radius center at the same center of the rotating disk 116 so the top of the first guide pin 120 can be located or aligned at the same radial distance to pass through the first groove 142.

A second groove 144 is located at a greater radial distance near the periphery of rotating disk 116. This permits the second guide pin 122 to pass through the second groove 144. The second grove 144 is further located between the first pushing section 140 and a pushing roller unit 146. The pushing roller unit 146 can rotate about a rotating axis which is parallel to the rotating axis of the rotating disk body 116. Referring to FIG. 3C and FIG. 4B, an outer roller ring 150 provides a contact point with the coin C and is capable of rotating about a fixed support post. Alternatively, the outer roller ring 150 can be changed in shape or size as long as it provides the same function.

In the preferred embodiment, the diameter of the rotating disk 116 is approximately a maximum of 80 mm and the diameter of the roller ring 150, which is attached at a position reverse of the rib 134 is approximately a maximum of 10 mm. The structure of the roller ring 150 which is showed in the preferred embodiment is designed for both durability and to be relatively inexpensive. It can be easily and efficiently removed and replaced for maintenance purposes.

The roller ring 150 includes a roller section 154 which is a cylinder and a flange section 156 which is located on an end surface. A bush hole 158 is located at the flange section 156. Roller ring 150 can be made from a polyacetal (POM) which can excel in mechanical strength while having a relatively low frictional characteristic to the metals from which coins are stamped. In this embodiment, the roller ring 150 can rotate smoothly while being of an inexpensive design. Because the roller ring 150 includes a large diameter section 162 and a small diameter section 166, it could also be made of a stainless steel for preventing rust as an alternative embodiment.

As shown in FIG. 4(B), a small diameter section 166 of bush 160 is inserted into an attaching hole 164 which penetrates through rotating disk 116 (a metal plate) from the reverse side of rotating disk 116. The top of bush 160 is fitted to a step section 168 in the attaching hole 164 and screw 170 is screwed into the small diameter section 166 from the surface side of the rotating disk 116. In other words, the bush 160 is fixed on rotating disk 116. In this situation, the lower surface of a large diameter section 162 is positioned away from the lower slide supporting base 118 by under 1 mm and is face to face to the slide supporting base 118.

Screw 170 which can be a flat-head Phillips screw is desirable, because it doesn't protrude to the upper surface of rotating disk 116, however, a screw which protrudes from the upper surface of rotating disk 116 could also be used because the screw head could further agitate the coins. When the rotating disk 116 is made of metal, bush 160 is further fixed by a caulking.

In this situation, the flange section 156 of roller ring 150 is located between the upper surface of the large diameter section 162 and the reverse side of the rotating disk 116 and is held suspended and rotable beneath the rotating disk 116. In other words, the large diameter section 162 of bush 160 and the lower end of roller ring 150 are located adjacent each other. In this structure, if screw 170 becomes loose and bush 160 falls, the end surface of a large diameter flange section 162 of bush 160 is supported by slide base 118, and small diameter section 166 is located inside of the attaching hole 164. Accordingly, the bush 160 will still rotate together with rotating disk 116 in an integral manner.

Also, roller ring 150 is rotatable about its axis, because it is supported by bush 160. Therefore the coins C will be dispense as usual. The outer surface of large diameter section 162 is fitted to the inner surface of roller section 154 of roller ring 150. In other words, large diameter section 162 bears roller ring 150. Therefore roller ring 150 is supported across its surface by the internal large diameter section 162 of bush 160. Roller ring 150 can be made from a polyacetal resin which has a relatively small friction of coefficient to metal coins. As a result, roller ring 150 can be rotated when in contact with a coin C.

A second pushing section 174 is located adjacent the roller ring 150 and at one side on the peripheral of rotating disk 116. The projecting quantity of second pushing section 174 is the same as first pushing section 140. The surfaces are located at the front of the rotating direction of roller ring 150 and the second pushing section 174 which is located on or neighboring line 176 goes back towards the rotating direction of rotating disk 116.

Figure 5:
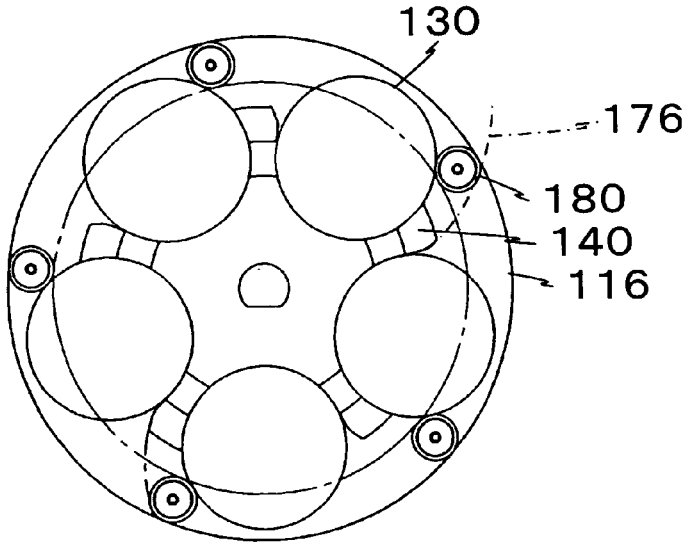
FIG. 5A is a reverse view of a rotable disk of a second embodiment of the present invention.
FIG. 5B is a perspective view of an upper surface of the rotable disk of the second embodiment.
FIG. 5C is a perspective view of the reverse side of the rotable disk of the second embodiment.
Figure 5:
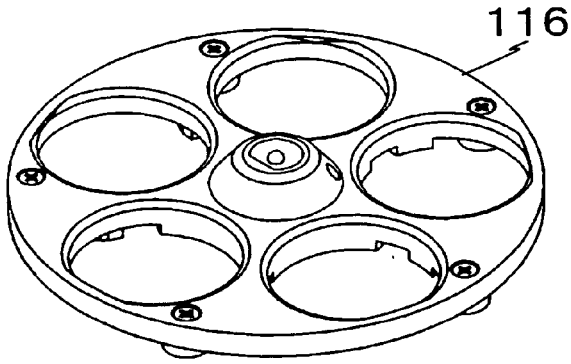
Figure 5:
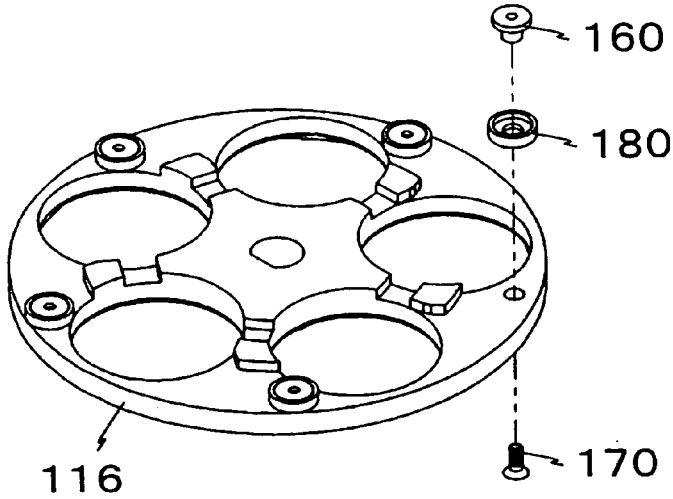

The line 176, shown in FIG. 5(A), is an involute curve and this shape is desirable for pushing the coins C smoothly across the slide supporting base 118. The line 176 can be changed to another line where the line can be located away from and opposite the rotating direction near the peripheral as an alternative configuration to the involute curve.

A roller ring 150 having a larger diameter is desirable for extended use. Therefore roller ring 150 of the first embodiment has contact with the through hole which is located at a retroposition of the rotation and line 176 as shown in FIG. 3(A). In other words, coins C aren't prevented from falling through the hole by the roller ring 150 and the roller ring 150 can push the coins smoothly by the pushing section 136 after the coin passes through a hole. Therefore, in this embodiment, pushing section 136 includes first pushing section 140, pushing roller 146 and second pushing section 174.

A shaft hole 176 is located at the axis section of rotating disk 116 and is in a D shape and penetrates up and down. The output shaft (not shown) of a reducer (not shown) is fixed at the reverse of slide base 118 and is rotated by an electric motor is fixedly inserted into the axis hole 176.

Next, a dispensing operation of the coins C is explained. The coins which were inserted into the storing bowl 104 are located on the rotating disk 116 which in turn is located at the bottom of storing bowl 104. When the rotating disk 116 rotates, the coins C are agitated, and fall through holes 130, and are supported by the slide supporting base 118. The coins on slide base 118 contact pushing section 136, in other words, the coins are pushed by first pushing section 140, and rotate together with the rotating disk 116 as shown in a counter clockwise direction as shown in FIG. 2.

In this process, first pushing section 140 pushes the peripheral of coins C. The coins C receive a force which is towards the outside from the outer surface of first pushing section 140. Therefore, the coins C are guided by the circular surface of the lower section of storing bowl 104 and are moved together with rotating disk 116. When coins C are located at the outlet 128, the coins C aren't guided by the circular surface of storing bowl 104. Accordingly, the coins C are pushed towards the outlet 128 by a force which goes towards the outside. By this, the coins C move to the peripheral side of rotating disk 116. Therefore the coins C have contact with pushing roller 136, and the coins C are pushed by the roller 136 (shown in FIG. 2).

When the coins C don't move the outlet 128, the coins C are stopped by the first guide pin 120 and second guide pin 122, and are guided to the outlet 128. Coins C have contact with the guide roller 124 at the outlet 128, afterwards the coins C are pushed by pushing roller 146. The regulating roller 126 is moved away from guide roller 124 by the force of the coins C because the guide roller 136 is fixed, and the coins C are forced to move towards the periphery.

In this process, coins C are approximately moved in the rotating direction of rotating disk 116. The pushing section 136 moves relative to coin C and slides on the peripheral of the coin C. In other words, the contacting position between the pushing section 136 and the coins C changes to first pushing section 140, pushing roller 146 and second pushing section 174 one by one. In the pushing process of the coins C, pushing roller 146 has contact with coin C for the longest time.

Also coin C receives a movement resistance force from the spring force which is added to regulation roller 126, the coin's weight and the moving resistance. In other words, the contact pressure between coin C and pushing roller 146 increases. Roller ring 150 is rotable. Therefore the roller ring 150 rotates relative to the movement of the coin C. In other words, roller ring 150 doesn't scrape or slide across the coin C. As a result, the roller ring 150 is not subject to excessive wear.

Coin C is pushed by the second pushing section 174 and the diameter section of the coin C passes through the area between guide roller 124 and regulating roller 124. The regulating roller 126 is moved by the force of the guide roller 124 against a counter spring force, and is stopped at a predetermined position. As a result, the coin C which passes between guiding roller 124 and regulating roller 126 can't go back to the side of rotating disk 116, and the coin C is guided by coin guiding unit 108.

Next, a second embodiment is explained by referring to FIGS. 5(A), 5(B), and 5(C). In this embodiment, there isn't a second pushing section as compared with the first embodiment. In other words, there is only a first pushing section. In this embodiment, the diameter of pushing roller 146 can be increased to a larger size. Accordingly, there is a greater durability of the pushing roller 146. In other words, roller ring 180 of the second embodiment has contact with line 176, through hole 130 and the peripheral of rotating disk 116. Therefore the roller ring 180 can be made larger. The roller ring 180 can be further supported by either a ball-bearing or a needle bearing.

This present invention can also be used in a coin hopper without a guiding unit 108.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A rotating disk assembly for a coin hopper comprising:

coin storing bowl for storing coins;

a rotating disk which is located at a bottom of the coin storing bowl for transporting coins from the coin storing bowl to a release outlet, the rotating disk includes a pushing section for the coins, characterized in that, the pushing section is a roller unit for providing a rotable contact with the coin including a bush member which is fixed on the rotating disk to provide an axis parallel to a rotational axis of the rotating disk and includes a head section and a roller ring that can rotate about the head section.

2. The rotating disk assembly of claim 1, wherein the roller ring is positioned adjacent a coin through hole on the rotating disk at a periphery of the rotating disk.

3. A coin dispensing unit for operatively selecting and removing coins from a storage bowl, comprises;

a rotable disk having a plurality of apertures therein of a size to pass coins to be stored in the storage bowl;

a guide plate offset from the rotable disk for slidingly supporting a coin passing through one of the plurality of apertures; and a rotable roller unit positioned adjacent the downstream edge of one of the plurality of aperture on the rotable disk for relative rotation with a respective coin sliding on the guide plate, the rotatable roller unit extending towards the guide plate a sufficient distance to insure a pushing rotatable contact with the coin.

4. The coin dispensing unit of claim 3 wherein the rotable disk has an inner metal member sandwiched by a plastic exterior.

5. The coin dispensing unit of claim 4 wherein the metal member forms a downturned lip in each of the plurality of apertures.

6. The coin dispensing unit of claim 3 wherein the rotable roller unit includes a support bush with an enlarged flange and a roller ring rotatably captured by the enlarged flange.

7. The coin dispensing unit of claim 6 wherein the guide plate is offset from the rotable disk by a distance smaller than a length of the support bush wherein the support bush is captured between the rotable disk and the guide plate.

8. The coin dispensing unit of claim 6 wherein the roller ring is formed of a plastic resin material.

9. The coin dispensing unit of claim 6 wherein the rotable disk has an inner metal member sandwiched by a plastic exterior.

* * * * *